US012605018B2

(12) United States Patent
Flynn Shaner

(10) Patent No.: US 12,605,018 B2
(45) Date of Patent: Apr. 21, 2026

(54) TOILET-TO-URINAL ADAPTER AND RELATED METHODOLOGIES FOR POTTY-TRAINING CHILDREN

(71) Applicant: Julie Anne Flynn Shaner, Salt Lake City, UT (US)

(72) Inventor: Julie Anne Flynn Shaner, Salt Lake City, UT (US)

( * ) Notice: Subject to any disclaimer, the term of this patent is extended or adjusted under 35 U.S.C. 154(b) by 0 days.

(21) Appl. No.: 18/275,124

(22) PCT Filed: Jun. 30, 2023

(86) PCT No.: PCT/US2023/069533
§ 371 (c)(1),
(2) Date: Jul. 31, 2023

(87) PCT Pub. No.: WO2024/054706
PCT Pub. Date: Mar. 14, 2024

(65) Prior Publication Data

US 2025/0194870 A1 Jun. 19, 2025

Related U.S. Application Data

(62) Division of application No. 29/852,477, filed on Sep. 7, 2022, now Pat. No. Des. 1,071,108.

(60) Provisional application No. 63/404,403, filed on Sep. 7, 2022.

(51) Int. Cl.
*A47K 13/08* (2006.01)

(52) U.S. Cl.
CPC ..... *A47K 13/08* (2013.01)

(58) Field of Classification Search
CPC ..... A47K 13/08
See application file for complete search history.

(56) References Cited

U.S. PATENT DOCUMENTS

| | | | | |
|---|---|---|---|---|
| 4,612,676 | A | 9/1986 | Whitman | |
| 5,465,431 | A * | 11/1995 | Wertz | E03D 9/00 4/300.3 |
| 6,978,497 | B1 | 12/2005 | Miller | |
| 7,043,773 | B2 * | 5/2006 | McAleenan, Jr. | E03D 9/00 4/300.3 |
| 11,950,731 | B2 * | 4/2024 | Alrutz | A47K 13/08 |
| 2009/0172871 | A1 * | 7/2009 | Bird | E03D 9/00 4/300.3 |
| 2013/0212792 | A1 * | 8/2013 | Osborne | A47K 11/12 4/144.1 |
| 2021/0121027 | A1 | 4/2021 | Stikes, III | |

FOREIGN PATENT DOCUMENTS

| | | | |
|---|---|---|---|
| DE | 2020014001361 | U1 | 5/2014 |
| DE | 202015001623 | U1 | 8/2016 |
| DE | 202016-005275 | U1 | 11/2017 |
| WO | PCT/US23/69533 | | 10/2023 |

* cited by examiner

*Primary Examiner* — Christine J Skubinna
(74) *Attorney, Agent, or Firm* — The Buche Law Firm, P.C.; Bryce A. Johnson; John K. Buche

(57) ABSTRACT

Disclosed are adapters for a toilet rim or seat that converts the toilet to a urinal funnel and backsplash for children.

20 Claims, 12 Drawing Sheets

TOILET-TO-URINAL ADAPTER AND RELATED METHODOLOGIES FOR POTTY-TRAINING CHILDREN

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of adapters for a toilet rim or seat that converts the toilet to a urinal for children.

Background of the Invention

Children are often potty-trained by their parent(s) or guardian(s) so that, eventually, the children can privately deposit their own urine and feces into a family owned or public toilet-bowl for disposal via a sewage system. Unfortunately, the potty-training process can be disgusting, destructive (e.g., via stains), unsanitary, and time-consuming because untrained or partially-trained children frequently miss their toilet-bowl target (either directly or by backsplash) which spreads their waist seemingly everywhere. Male children are notorious for missing the toilet bowl target with their urine streams or ricochet. Accordingly, a need exists for a training device which tends to focus the urine stream and ricochet of a potty-training child.

SUMMARY OF THE INVENTION

In view of the foregoing, an object of this specification is to disclose adapters for a toilet rim or seat that converts the toilet to a urinal funnel and backsplash for children. In a preferred embodiment, the adapter may be a toilet bowl-to-urinal adapter comprising: an upright hood with a circumferential skirt, said hood featuring and a front facing lip around an opening, wherein a bottom of the front facing lip defines an edge of a funnel for directing a waste stream toward an inside of the hood, wherein an inside surface of the hood defines a back splash for said funnel and wherein the skirt features at least one foot for interfacing a toilet bowl or the toilet bowl's seat so that the funnel directs the waste stream toward the inside of the toilet bowl and the back splash further directs ricocheted portions of the waste stream toward the inside of the toilet bowl.

BRIEF DESCRIPTION OF THE EXEMPLARY VIEWS OF THE DRAWINGS

Other objectives of the disclosure will become apparent to those skilled in the art once the invention has been shown and described. The way these objectives and other desirable characteristics can be obtained is explained in the following description and attached figures in which.

Figure 1:
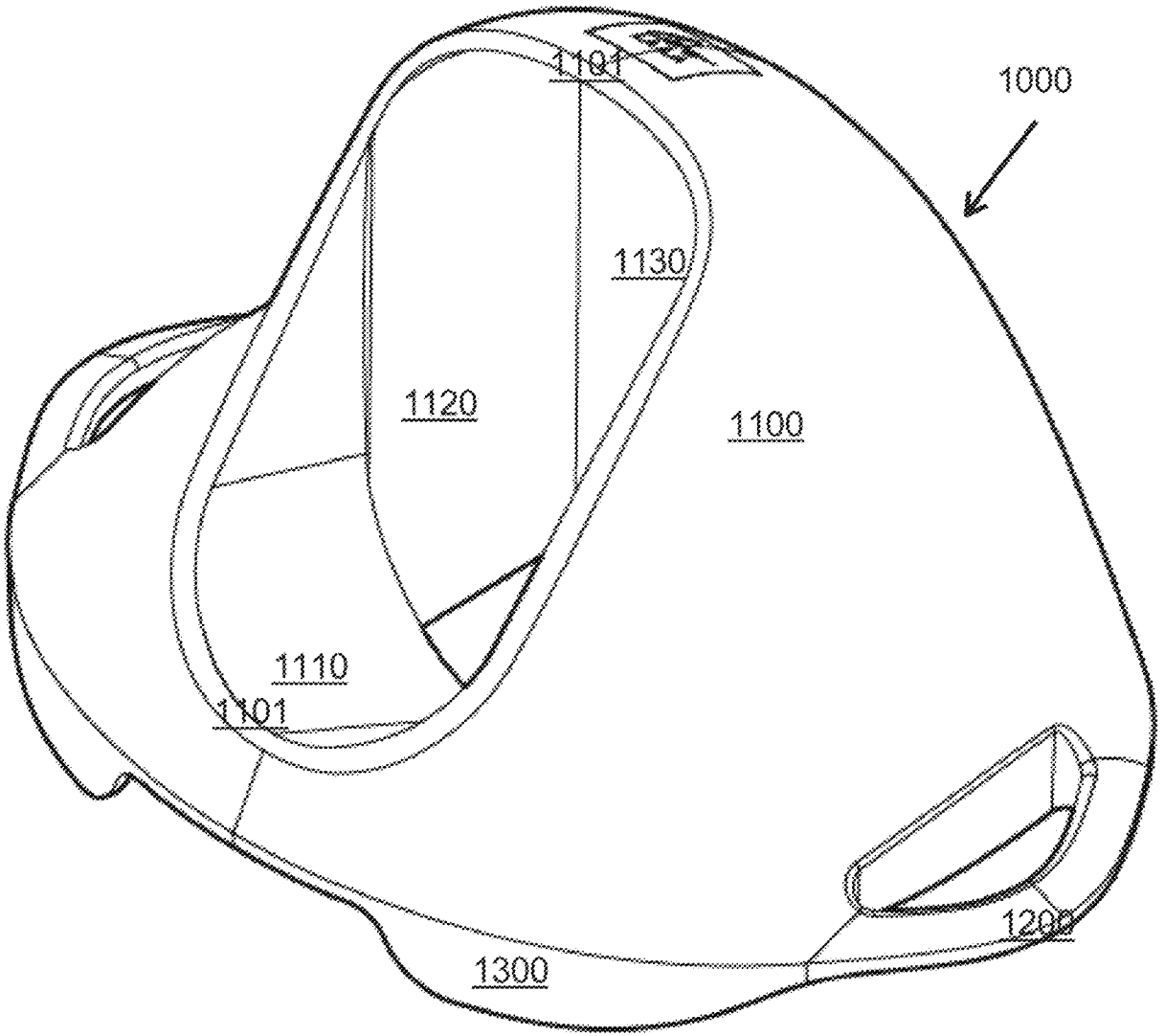
FIG. 1 is a perspective view of the toilet-to-urinal adapter.

In the figures, the following reference numerals are associated with the adjacent component part listing:

| |
|---|
| 1000 - toilet-to-urinal adapter |
| 1100 - hood |
| 1101 - front lip |
| 1110 - funnel |
| 1120 - internal sidewall |
| 1130 - back splash |
| 1200 - handle |
| 1300 - skirt |
| 1310 - foot |
| 2000 - toilet bowl |

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is a toilet bowl-to-urinal adapter comprising. Generally speaking, the adapter is defined by a funnel and a back splash for directing a waste stream and any ricocheted portion of the waste stream to within the toilet bowl. The more specific details of the adapter are disclosed in connection with the attached figures.

FIG. 1 is a perspective view of one preferred embodiment of an adapter 1000. FIGS. 2 through 6 are respectively bottom, back, front, left-side and top view of the preferred adapter 1000. As shown in these figures, the preferred adapter 1000 is composed of: an upright hood 1100 with a circumferential skirt 1300 that has handles 1200.

Figure 2:
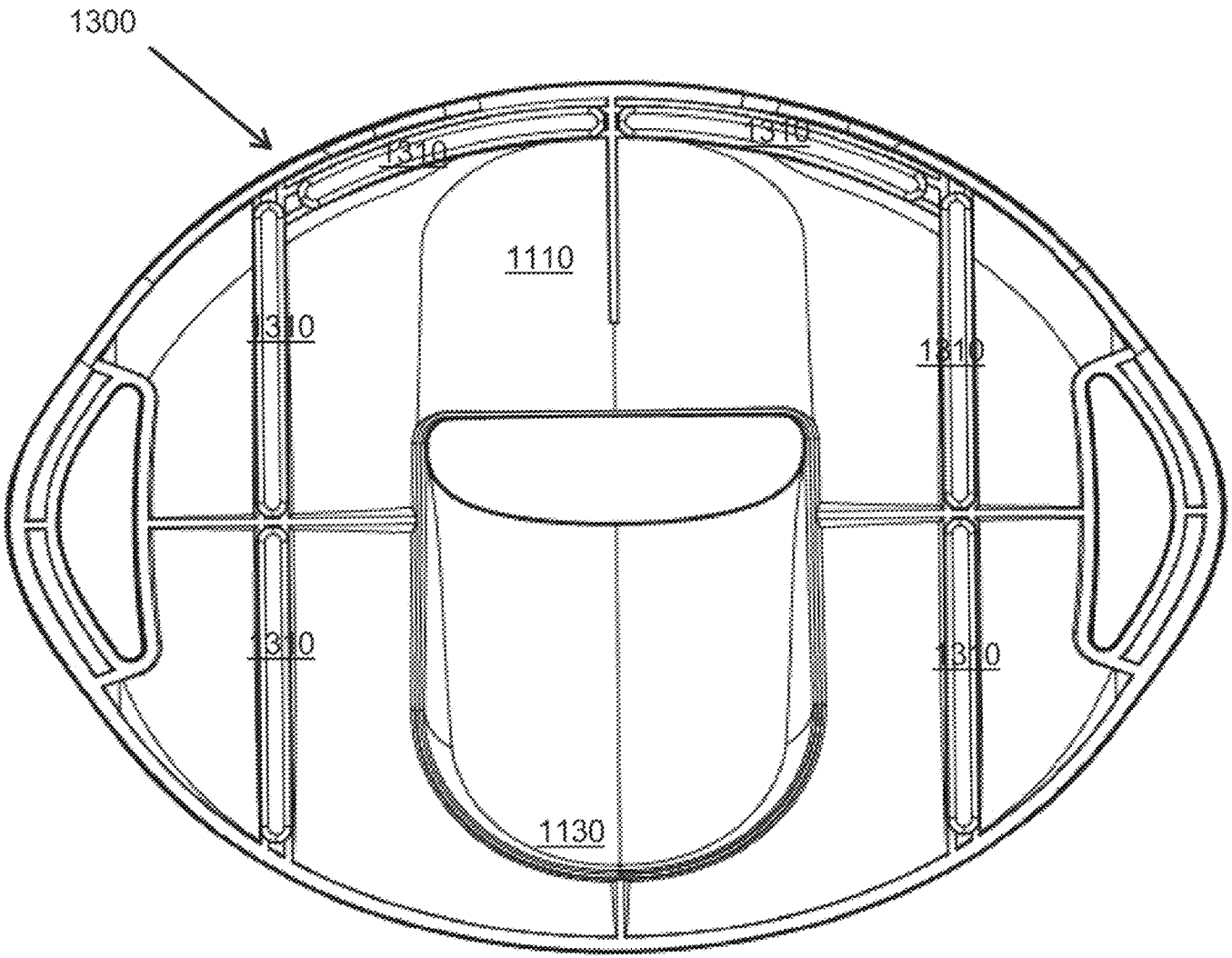
FIG. 2 is a bottom view of the toilet-to-urinal adapter.
Figure 3:
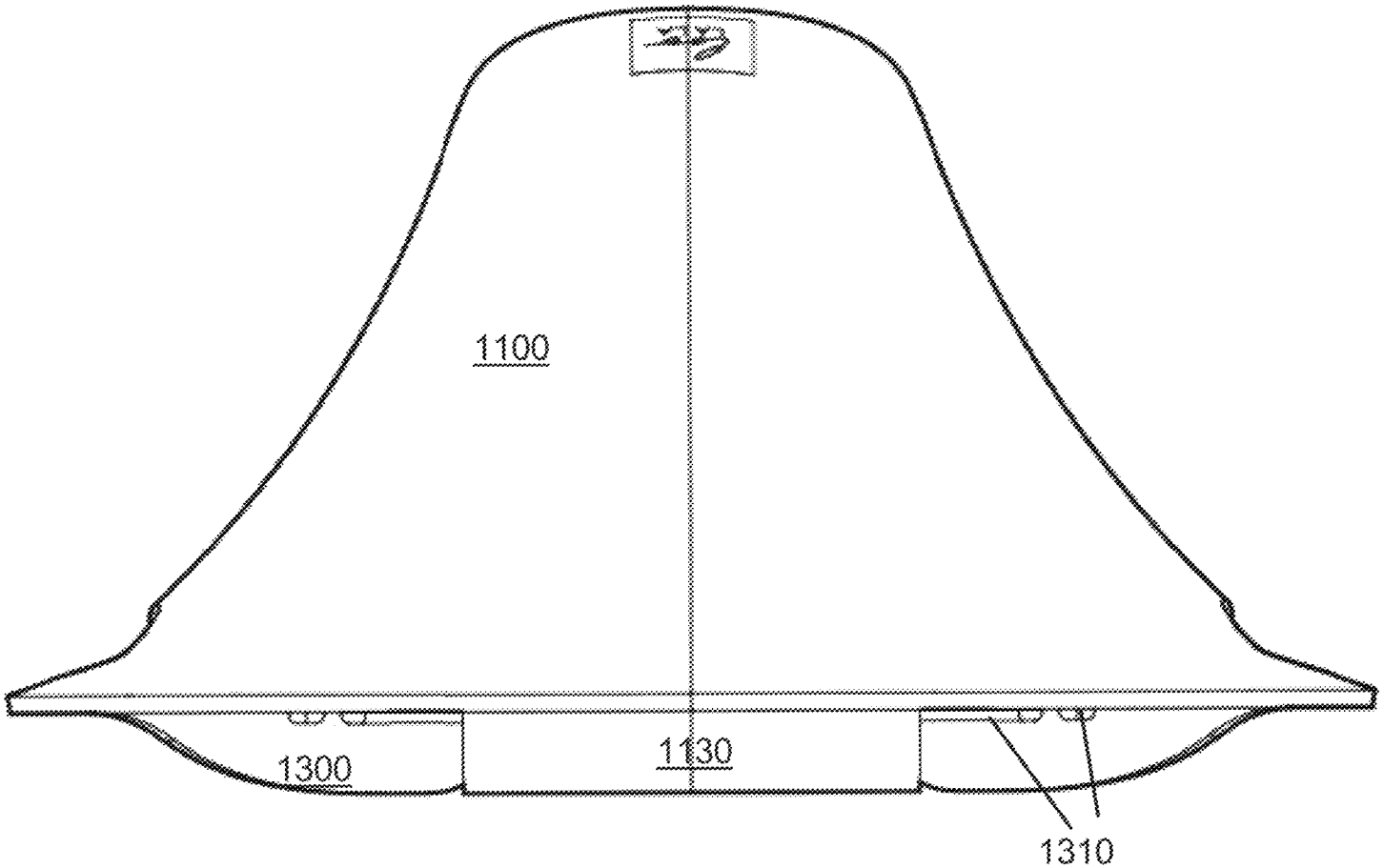
FIG. 3 is a backside view of the toilet-to-urinal adapter.
Figure 4:
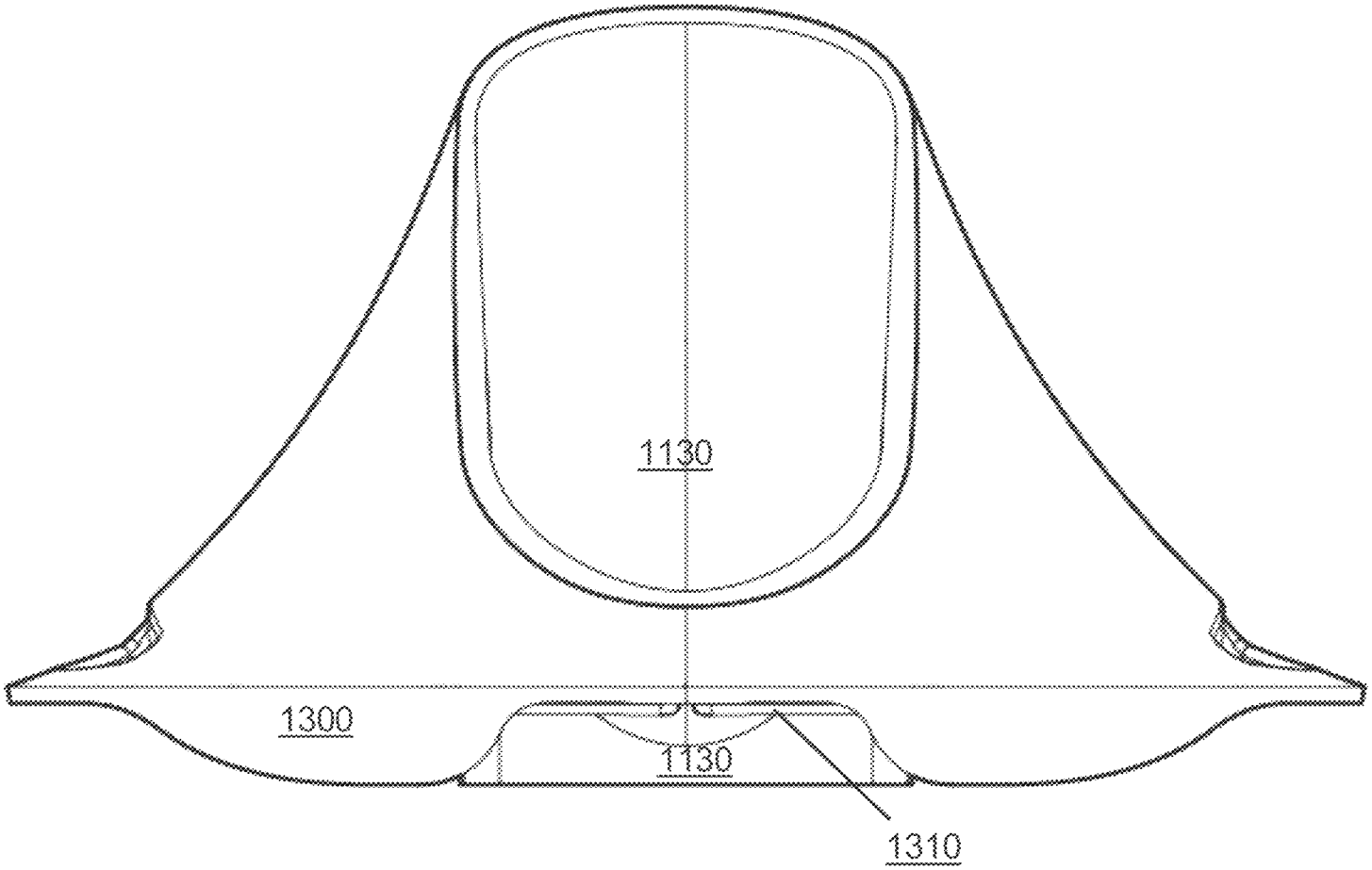
FIG. 4 is a front view of the toilet-to-urinal adapter.
Figure 5:
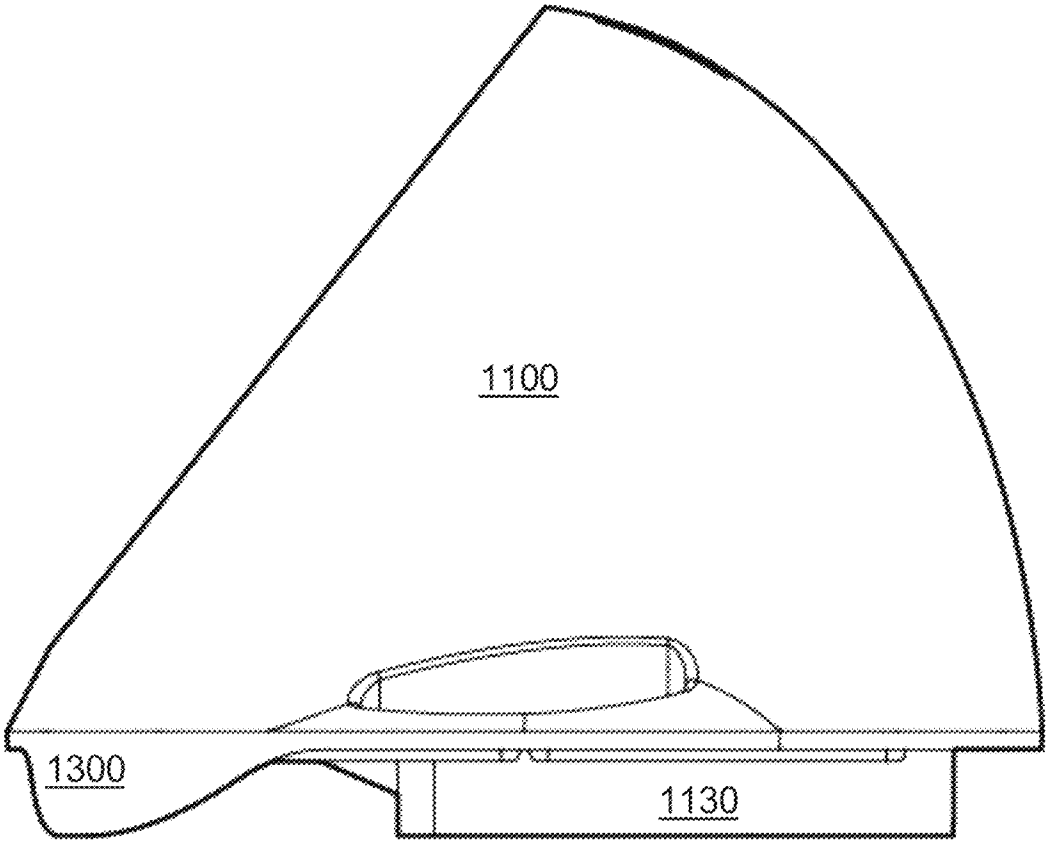
FIG. 5 is a left side view of the toilet-to-urinal adapter.
Figure 6:
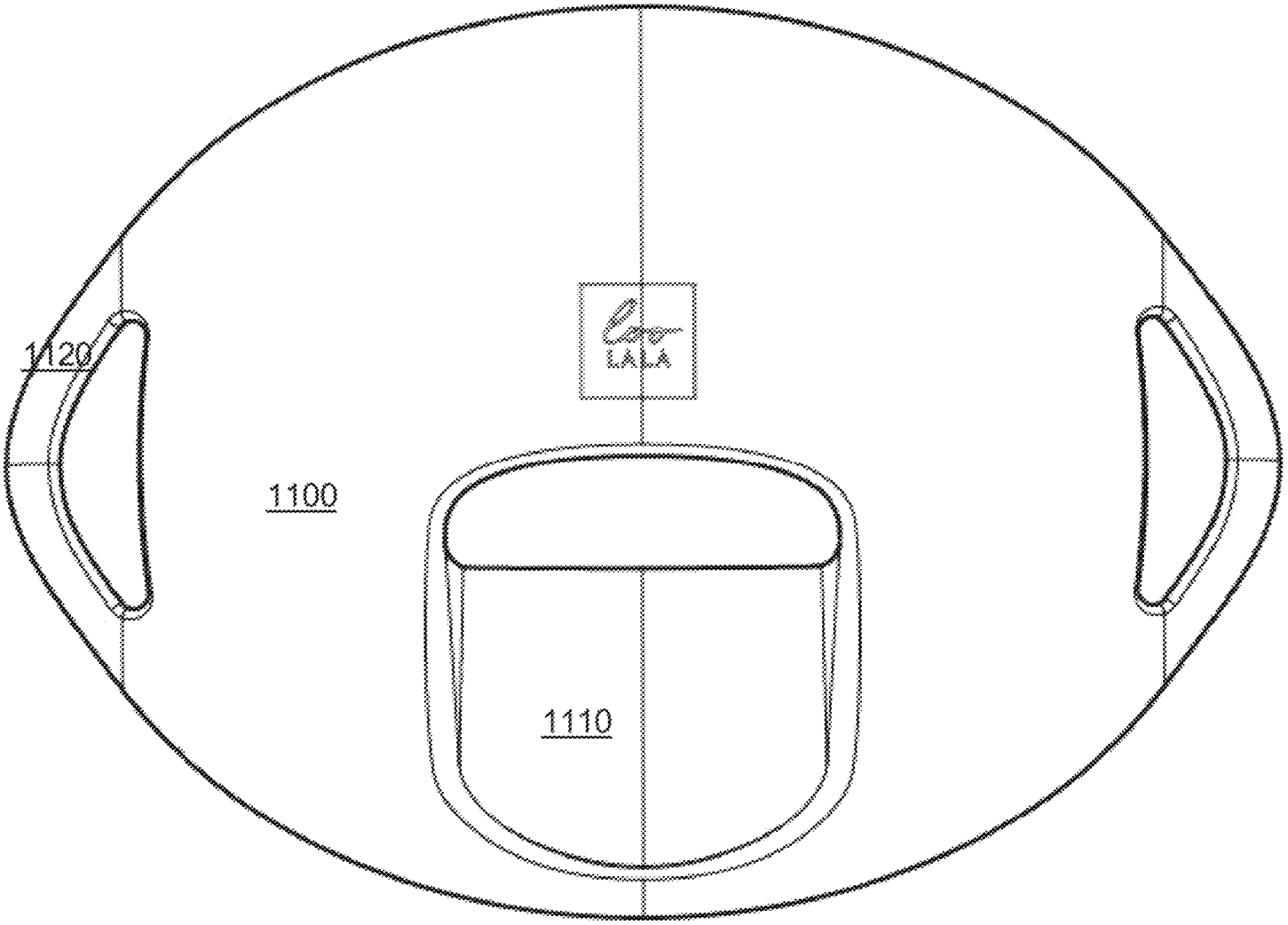
FIG. 6 is a top view of the toilet-to-urinal adapter.

In the most preferred embodiment, the upright hood 1100 suitably features and a front facing lip 1101 around an opening, wherein a bottom of the front facing lip 1101 defines an edge of a funnel 1110 for directing a waste stream (not shown) toward an inside of the hood 1000 while a top of the front facing lip 1101 defines an edge of a backsplash such that the funnel 1110 and backsplash 1130 define a channel further inside the hood 1100, said channel running between the front lip and the bottom of the adapter 10000 (see, e.g., FIGS. 2 and 6). As shown in FIGS. 1, 2, 4 and 6, the funnel 1110 and backsplash 1130 are seamlessly or seamingly connected by the sidewalls 11200 to define the channel identified above. As discussed further below, that the funnel 1110 directs the waste stream (not shown) toward the inside of the toilet bowl and the back splash further directs ricocheted portions of the waste stream toward the inside of the toilet bowl and wherein the skirt features at least one foot for interfacing a toilet bowl or the toilet bowl's seat.

Figure 7:
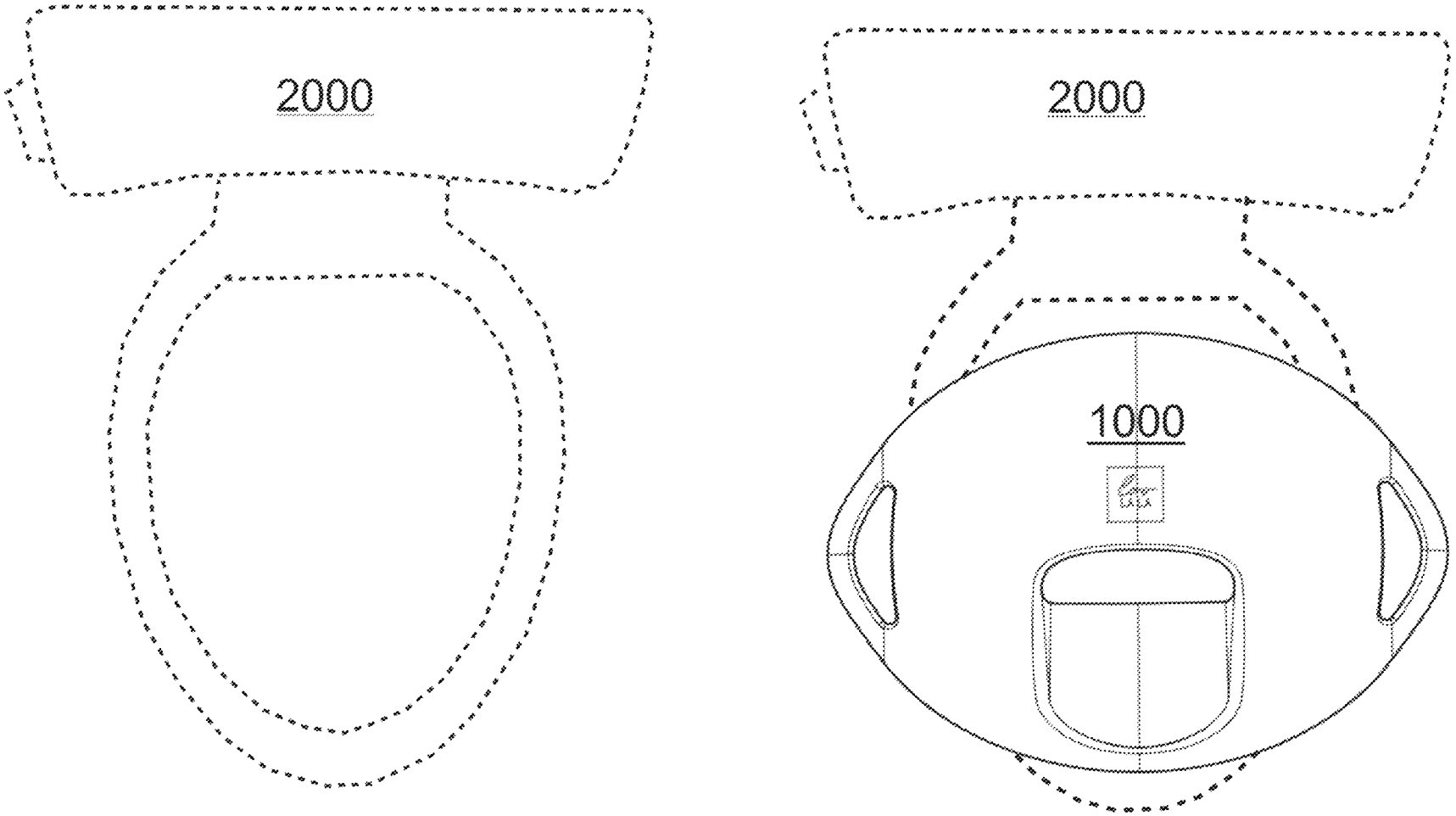
FIG. 7 is an environmental view of the toilet-to-urinal adapter.

FIG. 7 is an environmental view of the toilet-to-urinal adapter. Referring to FIGS. 2 through 5 and 7, the adapter 1000 features a skit 1300, with handles 1200. The handles 1200 provide a hand hold for setting the adapter 1000 in position atop a toilet bowl 2000 (see, e.g., FIG. 7). As shown in the identified figures, the skirt 1300 may suitably features at least one foot 1310 for interfacing a toilet bowl 2000 (FIG. 7) or the toilet bowl's seat (not shown) so that the funnel 1110 directs a waste stream (not shown) toward the inside of the toilet bowl 2000 and the back splash 1130 further directs ricocheted portions of the waste stream (not shown) toward the inside of the toilet bowl 2000. Suitably, the foot 1310 may provide a friction interface so that the adapter 1000 may not slide too much around the bowl 2000. Additionally, the skirt 1300 may provide forward interface with the toilet bowl 2000 so that a user may gauge the adapter's location on a toilet bowl 2000 by feel or by interfacings. Finally, as shown, the channel defined by the funnel 1110, side walls 1120, and back splash 1130 suitably extends below the bottom of the hood 1100 to at least the same extent as the skirt 1300 so that the waste stream (not shown) may have a high probability of entering the bowl 2000 while the adapter is positioned as shown in FIG. 7.

Figure 8:
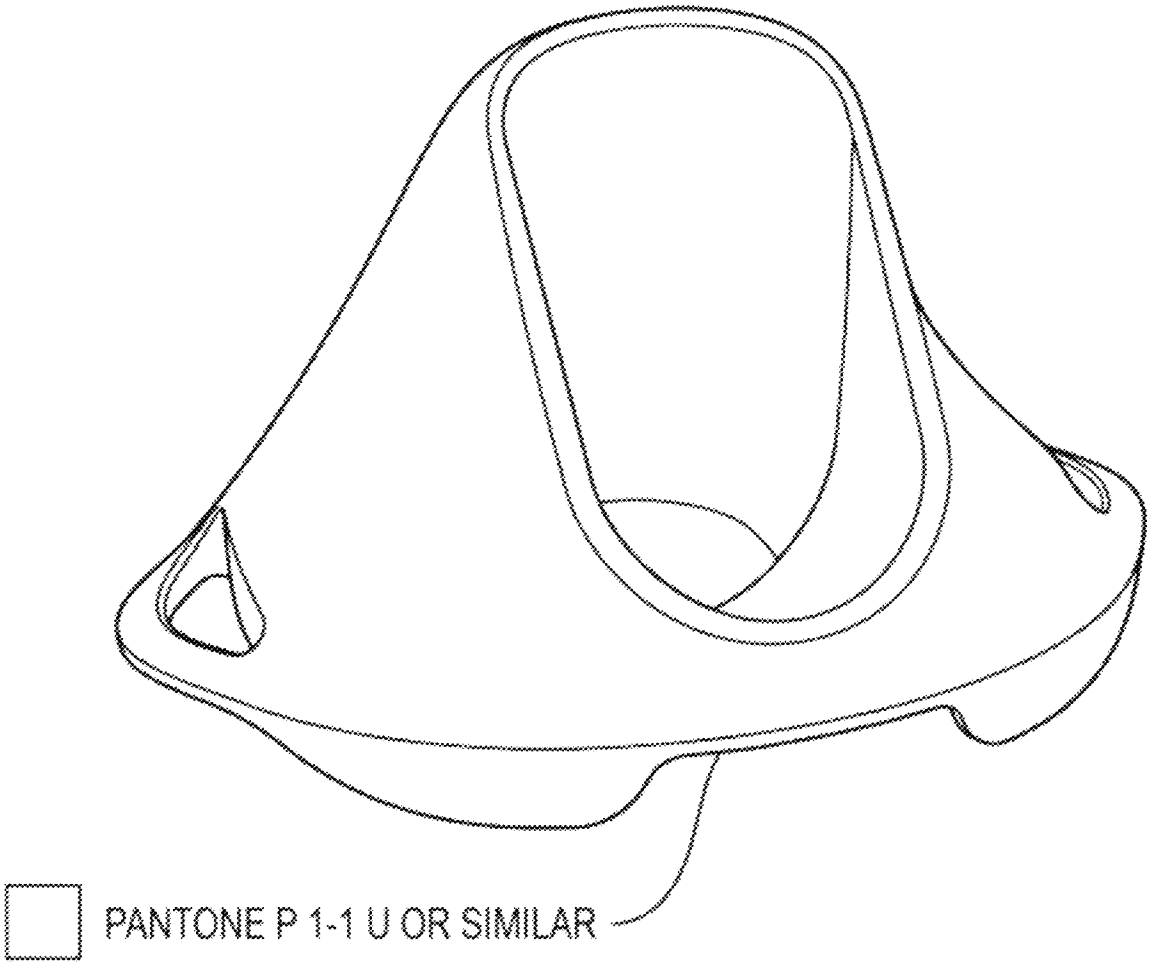
FIG. 8 is another environmental view of the toilet-to-urinal adapter.

FIG. 8 is another environmental view of the toilet-to-urinal adapter. As shown, the adapter may suitably be designed and colored to match common toilet bowl appearances. In particular, the adapter 1000 may be colored using PANTONE® P 1-1 U or similar coloring.

Figure 9:
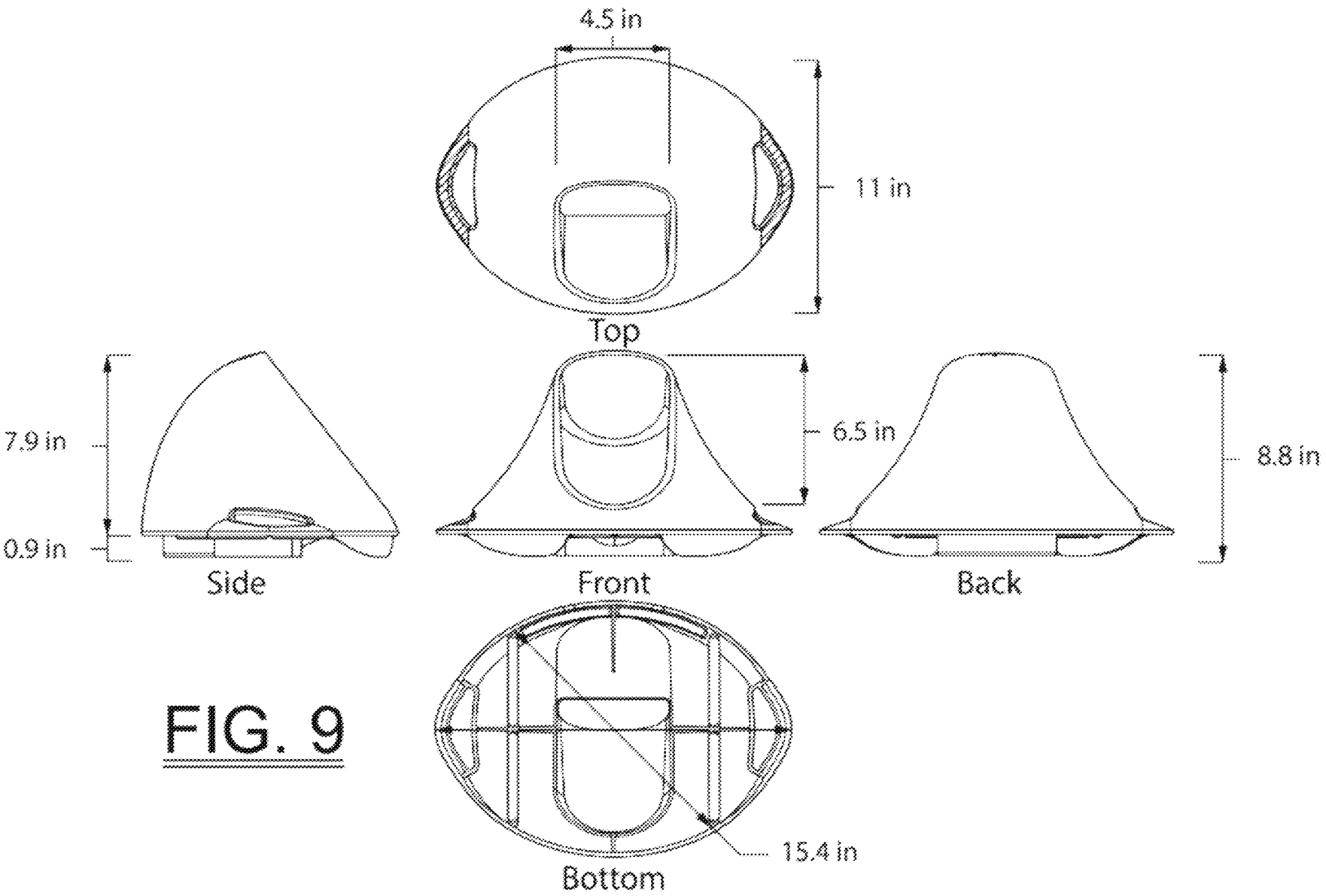
FIG. 9 is an orthographic, dimensional view of the toilet-to-urinal adapter.

FIG. 9 is an orthographic, dimensional view of the toilet-to-urinal adapter 1000. As shown, the dimension of the adapter 1000 with reference to the circumferential skirt 1300 may be elliptical with a width of about fifteen and four tenths inches (15.4 in) and a depth of about eleven inches (11 in). In one embodiment, the height of the upright hood 1100 relative to the bottom surface of the adapter 1000 may be seven and nine tenths inches (7.9 in), while the height of the upright hood 1000 relative to the handles 1200 may be six and a half inches (6.5 in). Suitably, the channel (defined by the funnel 1110, side walls 1120, and back splash 1130) may extend below the bottom of the hood 1100 by nine tenths of an inch (0.9 in). The opening of the hood 1100 (surrounded by the front lip 1101) may be four and a half inches (4.5 in) wide and six and a half inches (6.5 in) tall. Other dimensions could be conceivably used depending on the dimensions of the toilet bowl 2000 (FIG. 7), such that the dimensions identified may be illustrative of the preferred embodiment.

Figure 10:
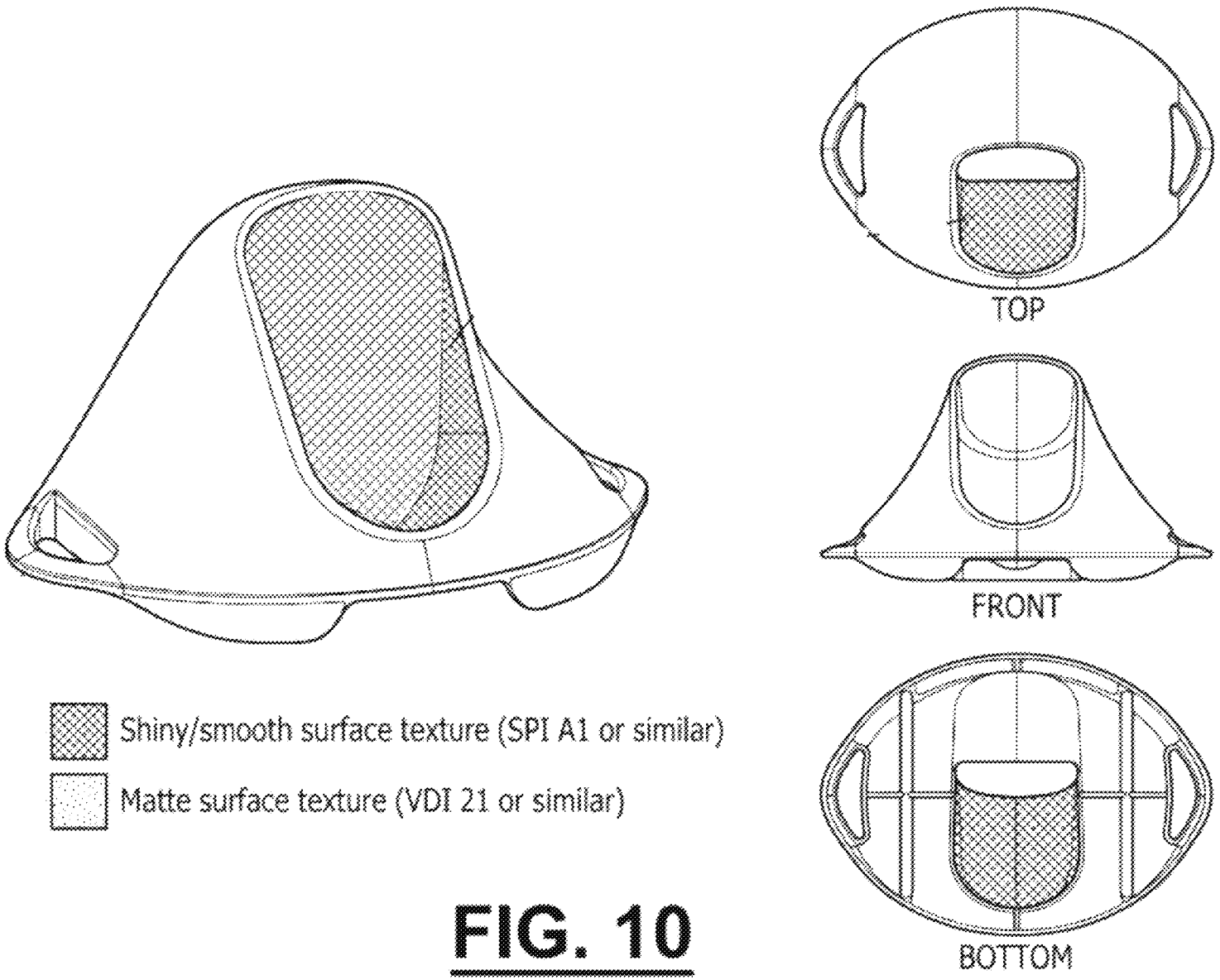
FIG. 10 is a contextual view of the toilet-to-urinal adapter.

FIG. 10 is a contextual view of the toilet-to-urinal adapter. As shown, the inner surfaces of the hood should be shiny/smooth in texture (e.g., 6PI A1 or similar) such that a waste stream (not shown) will have reduced surface tension when interacting with such surfaces whereby the stream will have a tendency toward the inside of the toilet bowl 2000 (FIG. 7). The exterior surfaces, as shown, of the adapter 1000 need not have a smooth texture and may instead have a matte finish (e.g., VDI 21 or similar). Those of skill in the art may appreciate different surface textures that may be suitable for use in other embodiments of the adapter.

Figure 11:
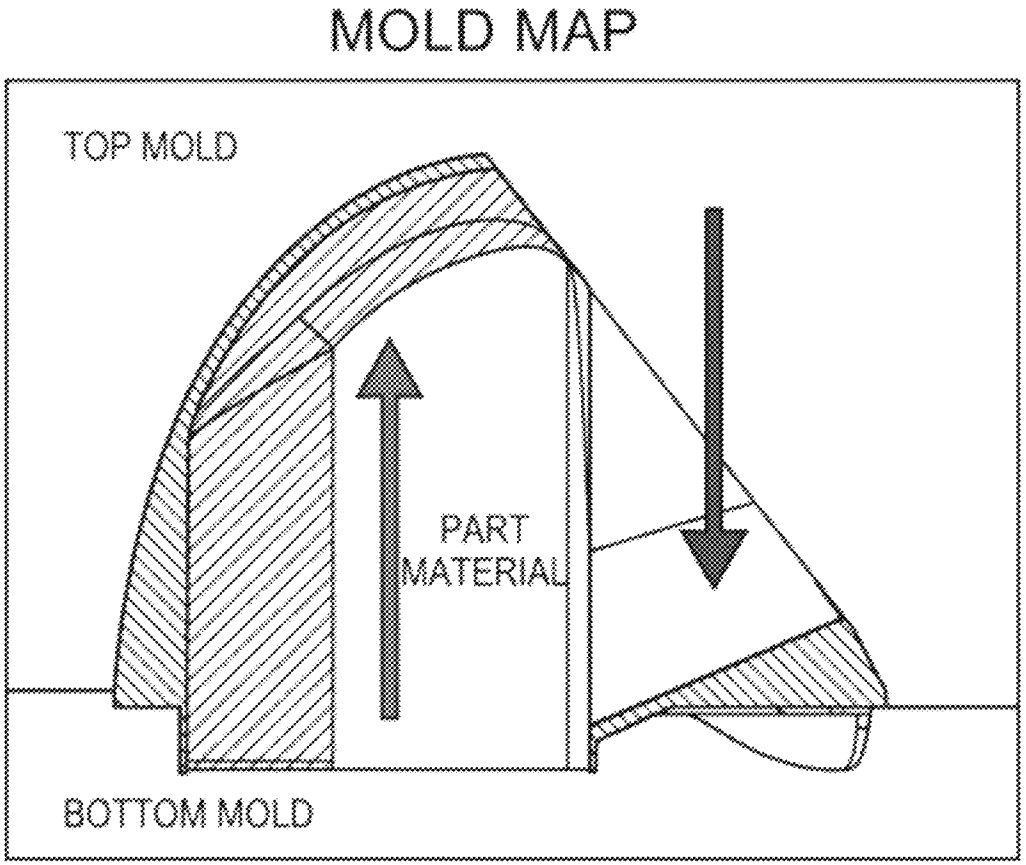
FIG. 11 is a cross section view of the toilet-to-urinal adapter.

FIG. 11 is a cross section view of the toilet-to-urinal adapter 1000. As shown, the adapter 1000 may be molded in to parts, where: (1) the first part is defined by the external surface of the hood 1000, the handles 1200, and funnel 1110; and (2) the second part is defined by the skirt 1300, feet 1310, backsplash 1130, and side walls 1200. The two parts may be suitably nested together as shown in FIG. 11.

Figure 12:
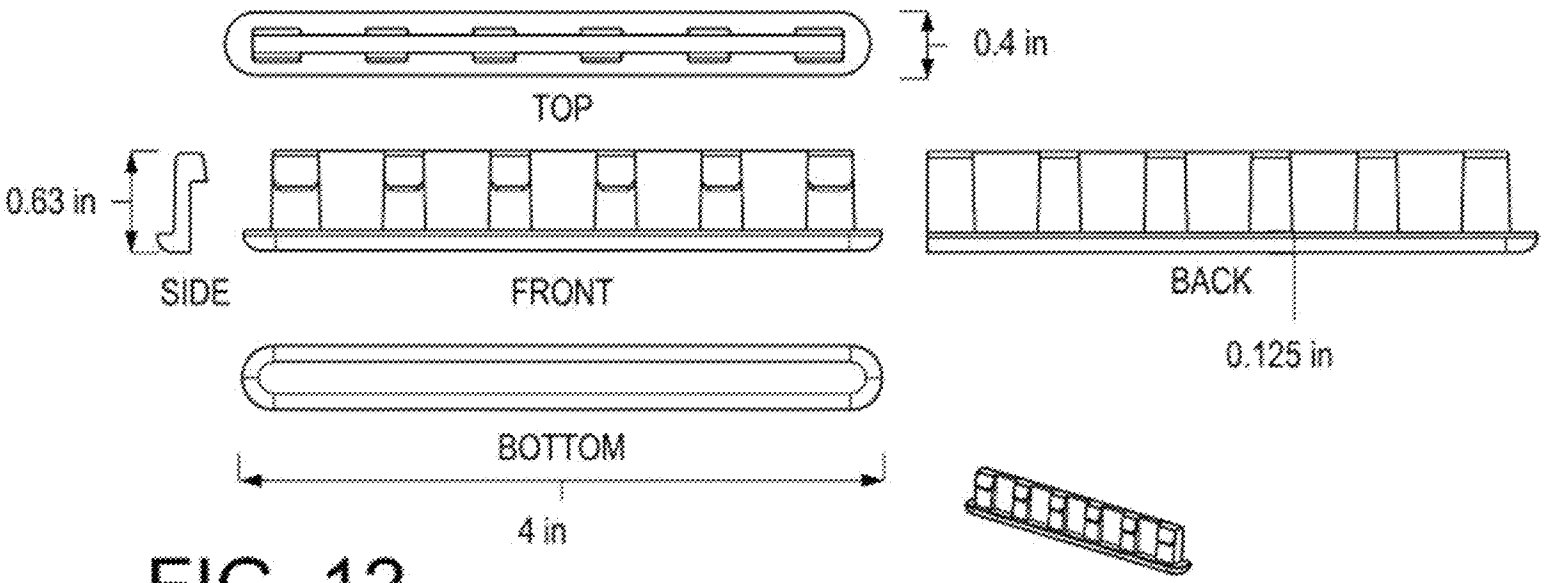
FIG. 12 is an orthographic, dimensional view of a foot of the toilet-to-urinal adapter; and, FIG. 13 is a constructive view of the toilet-to-urinal adapter.
Figure 13:
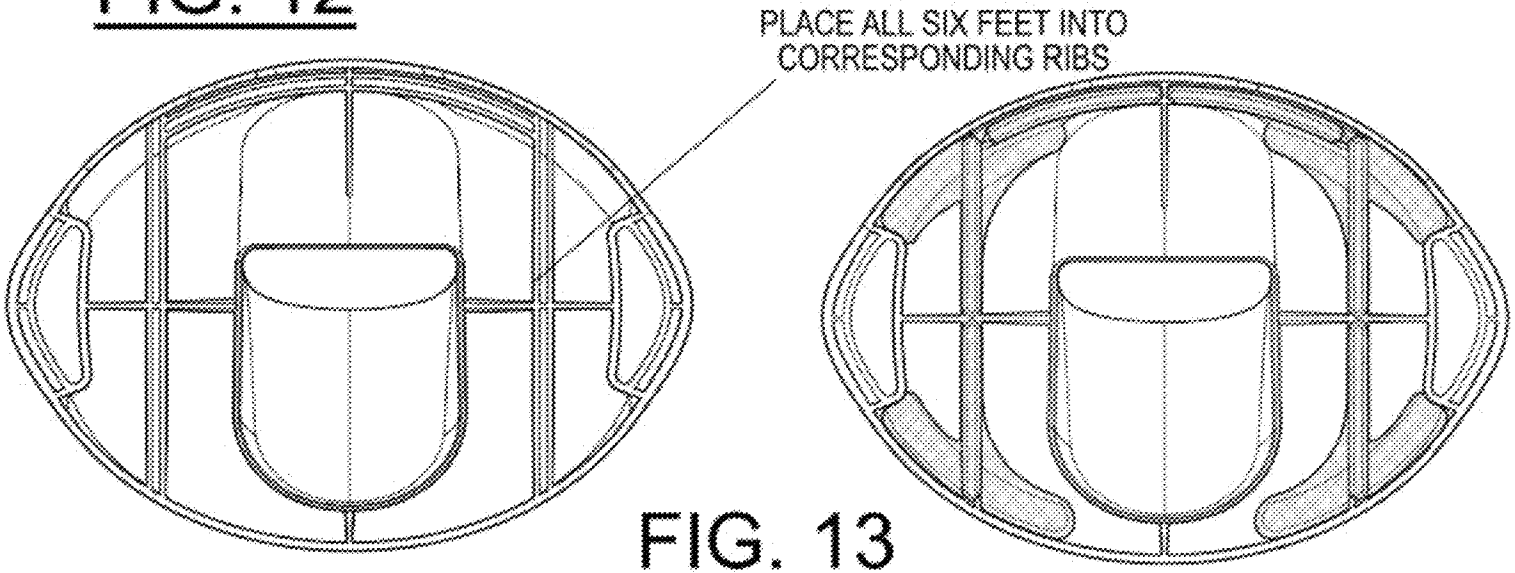

FIG. 12 is an orthographic, dimensional view of a foot 1310 of the toilet-to-urinal adapter. FIG. 13 is a constructive view of the toilet-to-urinal adapter 1000 that shows where a foot 1310 may be positioned on the underside of the adapter 1000 to define a grip or friction interface between the adapter 1000 and a toilet bowl 2000 (see FIG. 7). Each foot may be four inches (4 in) long, six and three tenths inches (6.3) tall, and four tenths of an inch (0.4 in) wide to define a buffer of one hundred and twenty five thousandths of an inch (0.125 in) between the adapter 1000 and a toilet bowl 2000 or seat (not shown).

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A toilet bowl-to-urinal adapter comprising:

a. an upright hood with a circumferential skirt, said upright hood featuring a front facing lip around an opening and said skirt featuring handles and a downright portion that has a forward interface with a toilet bowl or the toilet bowl's seat via receipt of either a tip of the toilet bowl or a tip of the toilet bowl's seat within a gap provided through the downright portion;

b. wherein a bottom of the front facing lip defines an edge of a funnel for directing a waste stream toward an inside of the hood; and, c. wherein an inside surface of the hood defines sidewalls and a back splash for said funnel, wherein the skirt features at least one foot interfacing an upper surface of a toilet bowl or the toilet bowl's seat, and wherein the at least one foot is positioned between the downright portion of the skirt and a channel defined by the funnel, sidewalls, and backsplash so that the channel extends into the toilet bowl such that the funnel directs the waste stream toward the inside of the toilet bowl and the back splash further directs ricocheted portions of the waste stream toward the inside of the toilet bowl.

2. The toilet bowl-to-urinal adapter of claim 1 where the foot provides a friction interface.

3. The toilet bowl-to-urinal adapter of claim 1 where the circumferential skirt is elliptical.

4. The toilet bowl-to-urinal adapter of claim 3 where the circumferential skirt has a width of about fifteen and four tenths inches (15.4 in) and a depth of about eleven inches (11 in).

5. The toilet bowl-to-urinal adapter of claim 4 where at least one inner surface of the upright hood is smooth in texture with a 6PI A1 smoothness or similar such that the waste stream will have reduced surface tension when interacting with said at least one inner surface whereby the stream will have a tendency toward the inside of the toilet bowl.

6. The toilet bowl-to-urinal adapter of claim 1 where the adapter is molded in two parts.

7. The toilet bowl-to-urinal adapter of claim 6 where a first molded part of the adapter is defined by any external surfaces of the upright hood, the handles, and funnel.

8. The toilet bowl-to-urinal adapter of claim 7 where a second molded part of the adapter is defined by the skirt, said at least one foot, said backsplash, and said sidewall.

9. A toilet bowl-to-urinal adapter installed on a toilet bowl comprising:

an upright hood featuring a front facing lip around an opening, wherein a bottom of the front facing lip defines an edge of a funnel for directing a waste stream toward an inside of the upright hood while a top of the front facing lip defines an edge of a backsplash such that the funnel and backsplash define a channel further inside the hood, said channel running between the front lip and a bottom of the upright hood, wherein the funnel and backsplash are seamlessly or seamingly connected by sidewalls to define the channel such that the funnel further directs the waste stream toward the inside of a toilet bowl and the back splash further directs ricocheted portions of the waste stream toward the inside of the toilet bowl;

a circumferential skirt that has handles, at least one foot interfaced with the toilet bowl or a seat of the toilet bowl so that the funnel directs the waste stream toward the inside of the toilet bowl and the back splash further directs ricocheted portions of the waste stream toward the inside of the toilet bowl, a downright portion that provides a forward interface with the toilet bowl via receipt of either a tip of the toilet bowl or a tip of seat within a gap provided through the downright portion; and, where the channel defined by the funnel, side walls, and back splash suitably extends below the bottom of the upright hood to at least the same extent as the downright portion of the skirt so that the waste stream has a probability of entering the toilet bowl while the adapter is installed on the toilet bowl.

10. The toilet bowl-to-urinal adapter installed on a toilet bowl of claim 9 where the foot provides a friction interface.

11. The toilet bowl-to-urinal adapter installed on a toilet bowl of claim 9 where the circumferential skirt is elliptical.

12. The toilet bowl-to-urinal adapter installed on a toilet bowl of claim 11 where the circumferential skirt has a width of about fifteen and four tenths inches (15.4 in) and a depth of about eleven inches (11 in).

13. The toilet bowl-to-urinal adapter installed on a toilet bowl of claim 12 where at least one inner surface of the upright hood is smooth in texture with a 6PI A1 smoothness or similar such that the waste stream will have reduced surface tension when interacting with said at least one inner surface whereby the stream will have a tendency toward the inside of the toilet bowl.

14. The toilet bowl-to-urinal adapter installed on a toilet bowl of claim 9 where the adapter is molded in two parts.

15. The toilet bowl-to-urinal adapter installed on a toilet bowl of claim 14 where a first molded part of the adapter is defined by any external surfaces of the upright hood, the handles, and funnel.

16. The toilet bowl-to-urinal adapter installed on a toilet bowl of claim 15 where a second molded part of the adapter is defined by the skirt, said at least one foot, said backsplash, and said sidewall.

17. A toilet bowl-to-urinal adapter installed on a toilet bowl comprising:

an upright hood featuring a front facing lip around an opening, wherein a bottom of the front facing lip defines an edge of a funnel for directing a waste stream toward an inside of the upright hood while a top of the front facing lip defines an edge of a backsplash such that the funnel and backsplash define a channel further inside the hood, said channel running between the front lip and a bottom of the upright hood, wherein the funnel and backsplash are seamlessly or seamingly connected by sidewalls to define the channel such that the funnel further directs the waste stream toward the inside of a toilet bowl and the back splash further directs ricocheted portions of the waste stream toward the inside of the toilet bowl;

an elliptical circumferential skirt that has a width of about fifteen and four tenths inches (15.4 in) and a depth of about eleven inches (11 in);

handles, at least one foot interfaced with the toilet bowl or a seat of the toilet bowl so that the funnel directs the waste stream toward the inside of the toilet bowl and the back splash further directs ricocheted portions of the waste stream toward the inside of the toilet bowl, a downright portion that provides a forward interface with the toilet bowl via receipt of either a tip of the toilet bowl or a tip of seat within a gap provided through the downright portion;

where the channel defined by the funnel, side walls, and back splash suitably extends below the bottom of the upright hood to at least the same extent as the downright portion of the skirt so that the waste stream have a probability of entering the toilet bowl while the adapter is installed on the toilet bowl; and, where the foot provides a friction interface.

18. The toilet bowl-to-urinal adapter installed on a toilet bowl of claim 17 where at least one inner surface of the upright hood is smooth in texture with a 6PI A1 smoothness or similar such that the waste stream will have reduced surface tension when interacting with said at least one inner surface whereby the stream will have a tendency toward the inside of the toilet bowl.

19. The toilet bowl-to-urinal adapter installed on a toilet bowl of claim 18 where the adapter is molded in two parts.

20. The toilet bowl-to-urinal adapter installed on a toilet bowl of claim 14 where a first molded part of the adapter is defined by any external surfaces of the upright hood, the handles, and funnel and where a second molded part of the adapter is defined by the skirt, said at least one foot, said backsplash, and said sidewall.

* * * * *